United States Patent [19]

Wilsey

[11] 4,410,796

[45] Oct. 18, 1983

[54] SEGMENTED HEATER ASSEMBLY

[75] Inventor: Harvey J. Wilsey, Sherman, Tex.

[73] Assignee: Ultra Carbon Corporation, Bay City, Mich.

[21] Appl. No.: 323,122

[22] Filed: Nov. 19, 1981

[51] Int. Cl.[3] ..... H05B 3/10

[52] U.S. Cl. ..... 219/553; 219/535; 219/541; 361/114; 361/125; 361/132; 361/134; 156/619

[58] Field of Search ..... 361/110, 114, 118, 132, 361/133, 134, 137, 125, 127, 128, 129, 130; 219/422, 426, 535, 536, 538, 541, 552, 553; 156/619; 264/81; 422/145

[56] References Cited

U.S. PATENT DOCUMENTS

| | | | |
|---|---|---|---|
| 1,189,725 | 7/1916 | Northrup | 373/127 |
| 2,650,254 | 8/1953 | Kremers | 373/110 |
| 2,966,537 | 12/1960 | Witucki et al. | 373/114 |
| 3,004,090 | 10/1961 | Donovan et al. | 373/128 X |
| 3,184,530 | 5/1965 | Properzi | 373/110 |
| 3,359,077 | 12/1967 | Arst | 156/619 |
| 3,469,013 | 9/1969 | Hetherington et al. | 373/134 |
| 3,798,007 | 3/1974 | Bochman et al. | 156/619 |
| 3,860,736 | 1/1975 | Ford | 374/134 X |
| 4,158,695 | 7/1979 | Ishizuka et al. | 422/145 |
| 4,259,278 | 3/1981 | Flegel et al. | 264/81 |

FOREIGN PATENT DOCUMENTS

| | | | |
|---|---|---|---|
| 222008 | 9/1924 | United Kingdom | 373/134 |
| 231090 | 3/1925 | United Kingdom | 373/134 |
| 241256 | 10/1925 | United Kingdom | 373/118 |

*Primary Examiner*—Volodymyr Y. Mayewsky
*Attorney, Agent, or Firm*—Learman & McCulloch

[57] ABSTRACT

A picket or zig-zag type heater for use in high temperature furnaces, such as are used for crystal growing for example, is constructed from a plurality of like graphite cylindrical shell segments assembled into a cylindrical shell having uniform resistance heating characteristics by graphite connector elements which also function to couple the electric current source to the heater.

8 Claims, 7 Drawing Figures

SEGMENTED HEATER ASSEMBLY

BACKGROUND OF THE INVENTION

The present invention is directed to so-called picket or zig-zag type heater elements employed in high temperature furnaces of the type, for example, used in crystal growing processes. (For examples of furnaces of this type, see U.S. Pat. Nos. 2,650,254; 2,966,537; 3,359,077 and 3,798,007.)

The picket type heating element employed in such furnaces is in the form of a cylindrical shell which surrounds the crucible holding the material to be critically heated. The heater conventionally is machined from a graphite composition into a cylindrical shape with relatively long axially extending slots extending alternately from opposite ends of the cylindrical shell at uniform spacing to each other to provide the "zig-zag" current path.

Particularly in crystal growing operations, the temperatures produced by the heating element must be not only relatively high temperatures, but also extremely uniform in terms of the application of heat to the crucible. Because the element operates as an elctrical resistance heater, the heat produced at any given location is directly proportional to the cross-sectional area of current flow. While it is possible to form and machine the heating elements with the necessary degree of precision, the completed graphite heating element is quite brittle and subject to cracking or chipping, even when extreme care is used in handling and cleaning the element. Because a relatively small crack or chip can have an unacceptably deleterious effect upon the uniformity of heating produced by the element, such heating elements, which are very expensive, require frequent replacement.

The present invention is especially directed to such a heating element which is constructed in individual segments, rather than as a monolithic element, and a connector arrangement by means of which the segments can be assembled to each other without adversely affecting the heat distribution of the assembled elements.

SUMMARY OF THE INVENTION

In accordance with the present invention, a heating element is constructed by first forming and slotting the cylindrical shell-like element in accordance with conventional practice. The completed element is then cut into a plurality of like segments by extending selected ones of the slots through the entire length of the element. Graphite connector elements are bolted bi-axially with radially extending graphite screws to two adjoining segments to reassemble the segments into cylindrical form, the connector elements also each being provided with an integral lug portion which may be employed as a connector to an electric current supply line for the heater.

Other objects and features of the invention will become apparent by reference to the following specification and to the drawings.

IN THE DRAWINGS

Figure 1:
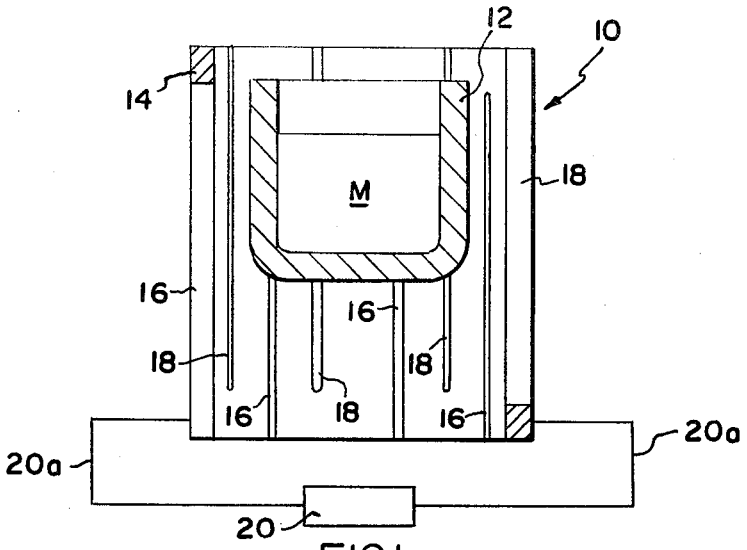
FIG.1 PRIOR ART
FIG. 1 is a schematic cross-sectional view of a typical prior art furnace arrangement in which the improved heater of the present invention is to be employed.

The schematic diagram of FIG. 1 is solely for the purpose of indicating a general environment in which the heater of the present invention may be employed. A high temperature furnace is schematically illustrated at 10 and includes a crucible 12 which contains the material M (such as molten silicon) being heated, the crucible being surrounded by a generally cylindrical heater element 14 of the so-called picket type formed from graphite and having axially extending slots 16 and 18 respectively, extending axially from oppoiste ends of the heater in alternation. The graphite composition used may be that disclosed, for example, in the instant assignee's U.S. Pat. No. 4,259,278 and patents mentioned therein. The heater is electrically connected to a current source 20 by current carrying lines 20*a*. (For a more detailed description of the general environment in which such heaters are used, see, for example, the Arst U.S. Pat. No. 3,359,077 and the Bochman et al. U.S. Pat. No. 3,798,007.)

Figure 6:
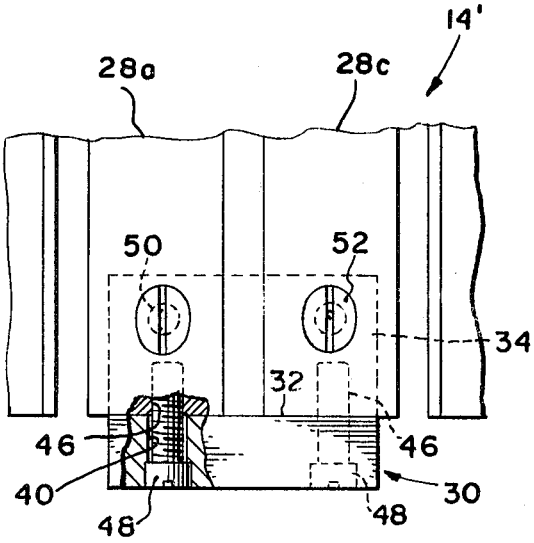
FIG. 6 is a detail side elevational view of a portion of the assembled heater element.
Figure 7:
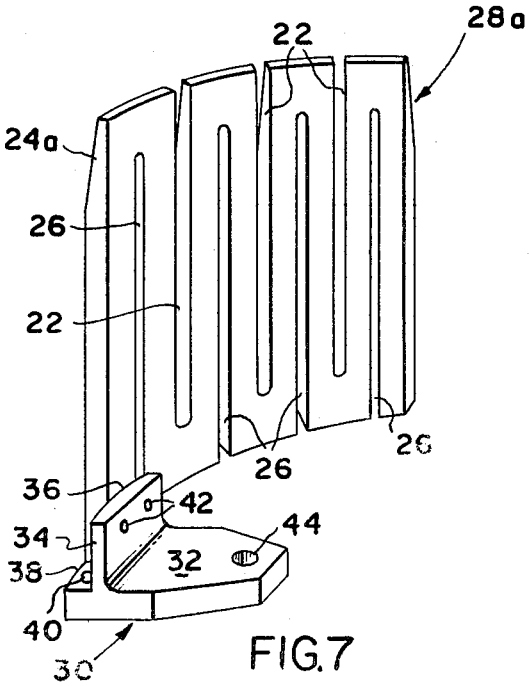
FIG. 7 is a fragmentary, perspective elevational view of the heater with an attached connector.
Figure 2:
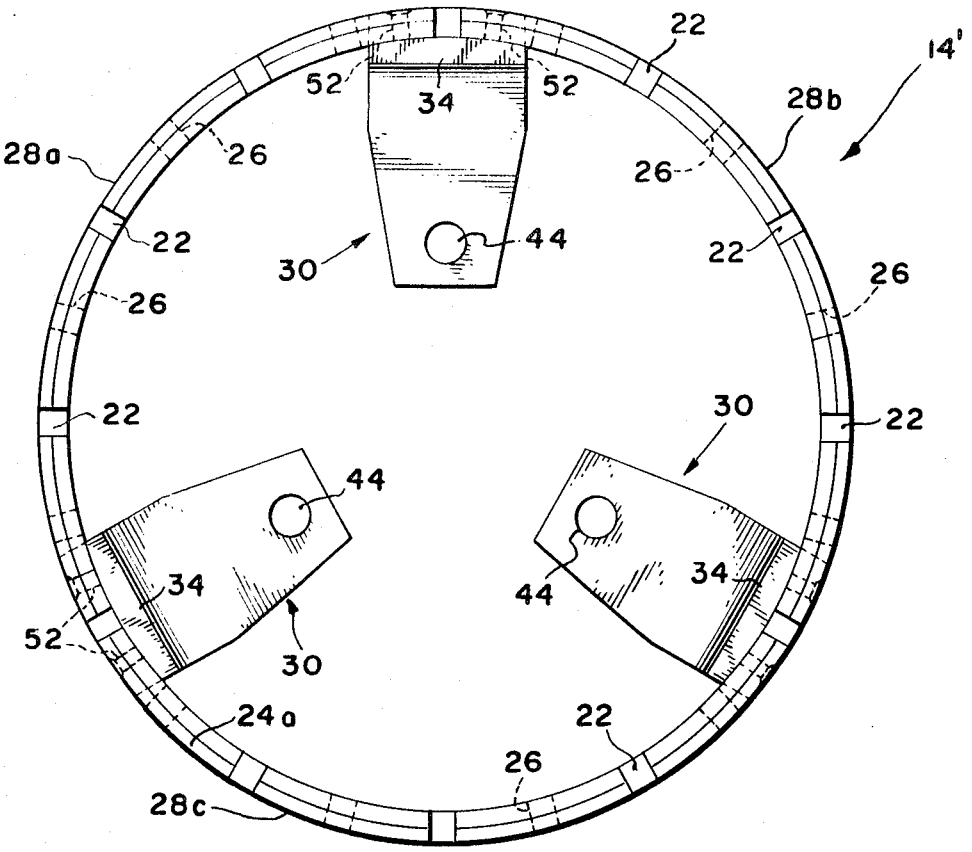
FIG. 2 is an enlarged top plan view of a heater embodying the present invention.
Figure 3:
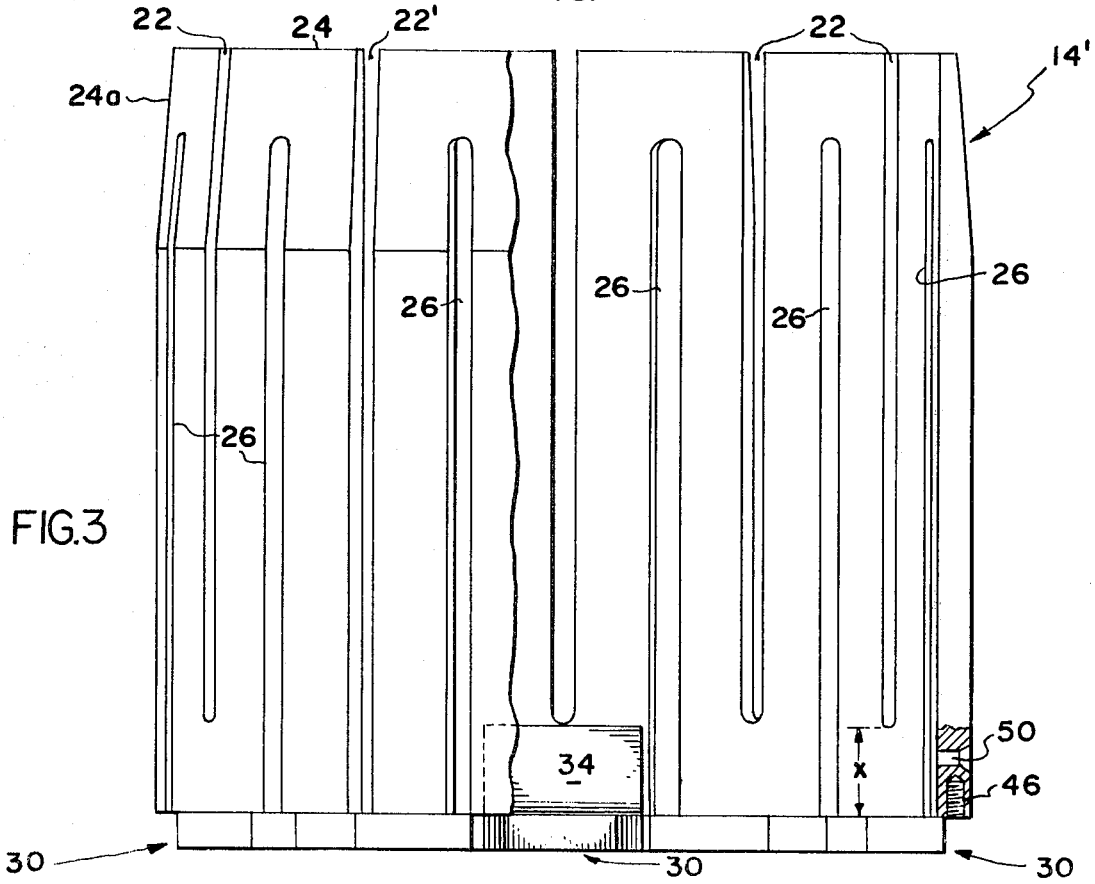
FIG. 3 is a side elevational view of the heater of FIG. 2 with certain parts broken away and shown in section.

The present invention is specifically concerned with an improved form of heater element which is designated generally 14' in FIGS. 2, 3, and 6. As best seen in FIGS. 2 and 3, the overall heater assembly 14' is of a tubular or cylindrical shell-like overall configuration having a first series of slots 22 extending axially downwardly from its top edge 24 (FIG. 3) and a second series of axially extending slots 26 extending axially upwardly from its bottom edge. The equal width slots 22 and 26 are uniformly circumferentially spaced from each other, the axial length of slots 22 is equal to that of slot 26, and, as best seen in FIG. 3, the slots do not extend for the entire axial length of the heater, with an exception to be described below. At its upper end the heater ring is beveled to form a heater upper edge of reduced cross-sectional area as at 24*a*.

The heater element 14' is constructed by first machining a cylindrical blank of graphite to the desired final dimensions of the cylindrical shell and then cutting the slots 22 and 26. Three of the slots 22 are then extended for the full length of the cylindrical heating element at uniformly spaced positions such as 22' (FIG. 2) to separate the cylindrical element into three like cylindrical shell segments 28*a*, 28*b* and 28*c*. The separated segments 28*a*, 28*b* and 28*c* are then reassembled into their original relationship with each other by three graphite connector members designated generally 30, shown in detail in FIGS. 4 and 5.

Figure 4:
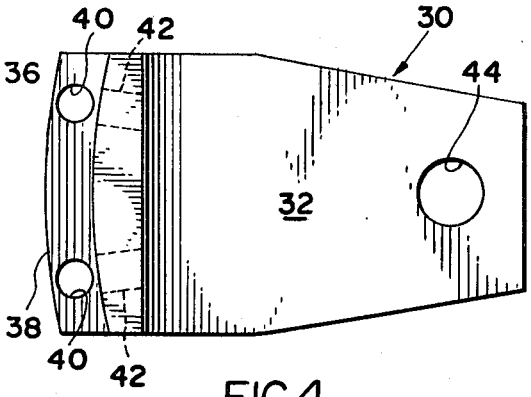
FIG. 4 is a top plan view of a connector element used in the heater of FIG. 2.
Figure 5:
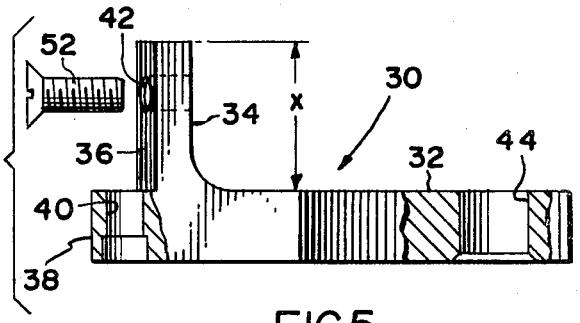
FIG. 5 is a side elevational view of the connector of FIG. 4.

Referring now particularly to FIGS. 4 and 5, each connector element 30 is constructed as a one-piece element from the same graphite material as employed in cylindrical shell segments 28*a*, 28*b* and 28*c*. Each connector element 30 includes a generally flat base 32 having an integral upwardly projecting flange 34. The outer surface 36 of flange 34 is convexly curved to the same radius as the inner diameter of cylindrical shell sections 28*a*, etc., and is spaced inwardly from the outer edge 38 of base 32 by a distance equal to the wall thickness of cylindrical shell sections 28*a*, etc. A pair of vertical bores 40 extend vertically through the base 32 at locations outwardly of flange 34, while a pair of threaded bores 42 extend through flange 34 radially of the curved outer side surface 36 of the flange. A fifth bore 44 extends through connector base 30 near its inner end to provide a means for connecting an electrical current supply line (not shown) to the connector. Thus, a line 20*a* connects via a terminal secured in each of the three bores 44 to a three phase power supply.

Referring now particularly to FIG. 6, there is shown a detail of the manner in which a connector 30 is employed and attached to two adjacent shell segments such as 28*a* and 28*c* to assemble the two segments to each other. Each of the segments 28*a* and 28*c* has a vertically extending threaded bore 46 which will receive graphite screws 48 seated in bores 40 in the connector 30. Also, each of segments 28*a* and 28*c* is formed with a radially extending bore 50 which will receive a screw 52 which passes through the cylindrical shell segment and is threaded into the tapped bores 42 in the flange of connector 30.

This arrangement finds the three cylindrical segments 28*a*, 28*b*, and 28*c* detachably assembled to each other with the individual segments truly concentric about a common central axis, with the spacing between adjacent segments as at the slots 22' being equal to the width of the remaining slots 22 and 26, and with the cross-sectional are to current flow presented by connector 30 corresponding to that presented by the unslotted portions of the individual segments. Thus, the dimension x in FIG. 5 is substantially the dimension x in FIG. 3, and the width and length of part 34 being chosen to provide a cross-sectional area which provides a resistance heat output at the connector 30 connected pickets similar to that of the other integrated heater pickets. Cracking or chipping of one of the expensive individual segments 22*a*, etc. requires only that that individual segment be replaced, and does not require the scrapping of the entire heating element.

While one embodiment of the invention has been described, it will be apparent to those skilled in the art that the disclosed embodiment may be modified. Therefore, the foregoing description is to be considered exemplary rather than limiting, and the true scope of the invention is that defined in the following claims.

What is claimed is:

1. For use in a high temperature furnace of the type having a resistance heating element of cylindrical shell-like shape having a plurality of like uniformly spaced slots extending axially less than the axial length of the shell alternately from opposite ends of the element;

a heating element assembly comprising a plurality of like discrete cylindrical shell segments of rigid graphite each having n like uniformly spaced slots extending axially from one end of the segment and n+1 like slots extending axially from the opposite end of the segment uniformly spaced between the first mentioned slots, and a plurality of detachable discrete connectors of graphite mechanically and electrically connecting said segments to each other at the respective one ends of said segments to assemble the individual segments into a rigid cylindrical shell, each connector being secured to a pair of adjacent shell segments and having an arcuate flange abutting said segments which extends a distance axially approximately equal to the difference between the axial length of a slot and the axial length of a segment.

2. The invention defined in claim 1 wherein said connector means connect said discrete segments to each other with a circumferential spacing between adjacent segments equal to the circumferential width of said slots.

3. The invention defined in claim 2 wherein each of said connector means comprises a one-piece member having a flat base and an integral flange projecting upwardly from said base and having curved abutment surface at one side thereof complementary to the curvature of one face of the cylindrical shell segment, and first and second fastener means of graphite for respectively fastening two shell segments to said base and to said one side of said flange.

4. The invention defined in claim 3 further comprising means on said base for connecting said connector means to an electric current source.

5. The invention defined in claim 1 comprising at least three cylindrical shell segments.

6. The invention defined in claim 3 wherein said slots are of a like axial length less than the axial length of the segment and said flange of said connector means projects from said base by a distance equal to the difference between the length of a slot and the length of the segment.

7. For use in a high temperature furnace of the type having a resistance heating element of cylindrical shell-like shape having a plurality of like uniformly spaced slots extending axially less than the axial length of the shell alternately from opposite ends of the element;

a heating element assembly comprising a plurality of like partly cylindrical discrete rigid shell segments of graphite each having like uniformly spaced slots extending axially from one end of the segment to terminate short of the opposite end of the segment and like slots extending axially from the opposite end of the segment uniformly spaced from the first mentioned slots and terminating short of the said one end of the segment, said discrete segments being spaced apart from said one end to said opposite end with a spacing between segments equal to the width of said slots to provide a cylindrical heater of zig-zag construction with uniformly spaced pickets of uniform width, and a plurality of discrete rigid connectors of graphite disposed to bridge the spacing between segments mechanically and electrically connecting said segments to each other at the respective one end of said segments to assemble the individual segments into a rigid cylindrical shell having uniformly spaced pickets and hold the segments in uniformly spaced relation.

8. The assembly of claim 7 wherein said connectors each include a base on which said segments rest, and arcuate flange portions configured to said segments which extend axially to abut said segments, and means for connecting the connectors to a power source.

* * * * *